United States Patent [19]

Ross

[11] Patent Number: 4,605,063

[45] Date of Patent: Aug. 12, 1986

[54] CHEMICAL INJECTION TUBING ANCHOR-CATCHER

[75] Inventor: Richard J. Ross, Houston, Tex.

[73] Assignee: Baker Oil Tools, Inc., Orange, Calif.

[21] Appl. No.: 609,327

[22] Filed: May 11, 1984

[51] Int. Cl.[4] ..... E21B 23/00

[52] U.S. Cl. ..... 166/216; 166/313

[58] Field of Search ..... 166/244 C, 72, 375, 166/189, 85, 380, 336, 310, 313, 106, 126, 131, 133, 216, 217, 138

[56] References Cited

U.S. PATENT DOCUMENTS

| | | | |
|---|---|---|---|
| 2,658,459 | 11/1953 | Page | 166/212 |
| 2,803,259 | 4/1955 | Pesnell | 166/310 |
| 3,035,642 | 5/1957 | Page | 166/72 |
| 3,077,933 | 9/1961 | Bigelow | 166/217 |
| 3,844,345 | 10/1974 | Evans et al. | 166/72 |
| 4,306,624 | 12/1981 | Bernard et al. | 166/244 C |
| 4,371,038 | 2/1983 | Abernathy et al. | 166/244 C |
| 4,387,767 | 6/1983 | Read | 166/72 |

*Primary Examiner*—James A. Leppink
*Assistant Examiner*—Matthew Smith
*Attorney, Agent, or Firm*—Norvell & Associates

[57] ABSTRACT

An anchoring apparatus for securing a production tubing string against axial movement in a subterranean well is disclosed. The anchoring apparatus can be employed with a conventional sucker rod pumping apparatus transporting fluids through the production tubing. A separate injection line is attached to the exterior of the production tubing and treating fluids are injected therethrough. A conduit which can be connected to the separate injection line extends along the exterior of the inner body of the anchoring apparatus in an axially extending groove and extends through encircling anchoring slips which are expanded by rotational movement of the production tubing and of the body of the anchoring apparatus.

3 Claims, 5 Drawing Figures

CHEMICAL INJECTION TUBING ANCHOR-CATCHER

BACKGROUND OF THE INVENTION

1. Field of the Invention

This invention relates to a subterranean well tool for anchoring a tubing string within a well conduit and for providing a fluid passage for the injection of well treatment fluids through a flow line to a subsurface position below the well tool.

2. Description of the Prior Art

It is often necessary to inject fluids from the surface of a subterranean oil or gas well to a subsurface location. For example, it may be necessary to inject well treating fluids at a subsurface production zone. In many wells, the produced fluids are highly corrosive and it is often necessary to inject corrosion inhibitor to prevent damage to the production tubing string and to well completion tools. In many applications, it is necessary to inject treating fluids of this type while the well is producing. Conventional applications have employed dual tubing strings in which a smaller diameter tubing string is used to inject fluids while production continues through a larger bore tubing string. Conventional dual string well tools in which the two tubing strings can be attached through separate bores have been developed in part for such applications.

In addition to the conventional dual tubing string completions, other well completions have employed a single production tubing string with a smaller diameter continuous flow line comprising continuous tubings conventionally available in lengths of 300–1000 feet attached to the exterior of the individual tubing joint sections comprising a conventional production tubing string. Such injection flow lines generally have an outer diameter of approximately ¼ inch and can comprise tubing commonly referred to as control line tubing used for hydraulic pressure control in subsurface well tools.

When the use of external continuous injection tubing attached to production tubing joints, conventionally having a length of 30 feet, the interference with the flow of produced fluids through the production tubing string by the injection apparatus should be minimal. Such injection line completions can, however, interfere with the apparatus necessary for conventional produciton techniques. For example, it would be highly undesirable for the injection apparatus to reduce the production efficiency of conventional techniques, such as sucker rod pumping. Conventional sucker rod pumps are used to lift produced fluids from a subsurface zone having an insufficient bottom hole pressure to independently sustain production to the well surface. Conventionally, a sucker pump is seated on a pump seat located at the bottom of the production tubing string. A sucker rod string extending through the production tubing to the surface of the well is used to manipulate the pump. It is highly desirable that the production tubing be anchored to the casing of the well bore during sucker rod pumping operations to prevent vertical movement of the tubing during the pump cycle.

Conventional tubing anchors or anchor-catchers, such as that disclosed in U.S. Pat. No. 3,077,933, which is commercially available as shown on pages 1036–1039 of the "1982–83 Composite Catalog of Oil Field Equipment and Services", published by World Oil, can be used to prevent tubing overstress and prevent excessive rod and tubing wear. Frictional rod drag can also be prevented by the use of a tubing anchor, thus reducing surface power requirements. The conventional tubing anchor catcher apparatus shown in U.S. Pat. No. 3,077,933 employs radially expandable anchoring slips which are actuated by rotation of the tubing string. Such rotationally set well tools are highly desirable when used to prevent excessive axial movement of the tubing string. Conventional rotationally set anchor catchers cannot, however, be used with external injection flow lines attached to the tubing. An externally attached flow line, rotating with the tubing, would interfere with expansion of the anchoring slips during rotation of the tubing string to which the injection tubing is attached.

SUMMARY OF THE INVENTION

The invention disclosed herein, permits the use of a continuous external injection flow line attached to the production tubing string in conjunction with a rotationally set tubing anchor securing the production tubing relative to the well casing during cycling of a conventional sucker rod pump. The tubular body of the tubing anchor is attached to tubing sections above and below the tubing anchor to comprise one element in the continuous tubing string. In the preferred embodiment of the invention, upper and lower expanders are shiftable relatively towards each other to urge the anchoring slip means, located therebetween, radially outward into engagement with with the casing. An axially extending recess on the exterior of the tubular body of the tubing anchor extends through the expanders and the anchoring slips to receive a conduit which can be attached to the external control line. In the preferred embodiment of this invention, the conduit comprises a tubular member having the same outer diameter as the continuous injection tubing. The conduit is attached to the injection tubing above the anchoring slips, and can be similarly attached to injection tubing extending below the tubing anchor. In the preferred embodiment of this invention, the expanders are shifted axially by means of the engagement of threads on the exterior of the tubular body with threads located on the interior of the expanders. This axially extending groove or recess is sufficiently deep to receive the conduit and to provide clearance between the conduit and the expansion threads. The passage of produced fluids through the interior of the production string and through the tubular body of the tubing anchor continues without interference by the injection of fluids through the external injection line.

DESCRIPTION OF THE PREFERRED EMBODIMENT

Figure 4A:
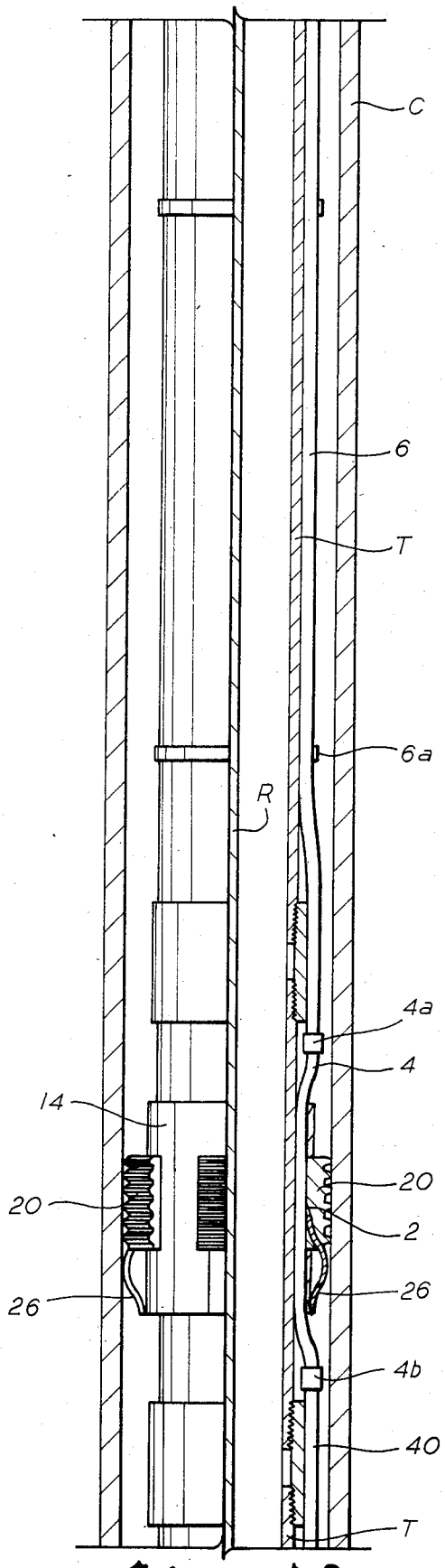
FIGS. 4A and 4B are schematic representations of the tubing anchor used with an external injection line in a sucker rod pumping completion.
Figure 4B:
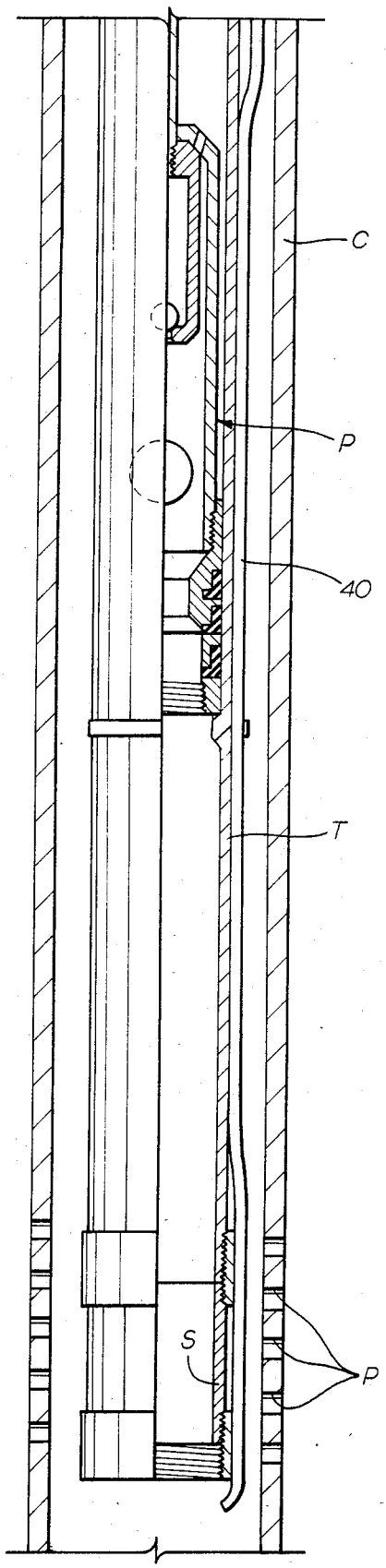

Referring to FIGS. 4A and 4B, a subterranean well having a casing C with a plurality of perforations P adjacent to a subsurface production zone is shown with a sucker rod pumping apparatus P and a tubing anchor 2 attached to the production tubing string T. The tubing string T comprises a plurality of threadably interconnected conventional tubing joint sections. The tubing anchor 2 is incorporated within the tubing string and has radially expandable anchoring slips 2 shown in anchoring engagement with the casing C. A single injection flow line 6 is attached to the tubing T by means of a circumferentially extending band 6*a*. The portion of the injection flow line 6 extending from the surface of the well to the tubing anchor 2 comprises a continuous tubular member having an outer diameter significantly less than the diameter of the production tubing T. In the preferred embodiment of this invention, the tubing 6 has an outer diameter on the order of ¼th of an inch and comprises tubing of the type commonly used for communicating hydraulic control pressures in subterranean wells. Such tubing is commonly referred to as control line tubing. A separate piece of injection flow line tubing 6 extends from the tubing anchor 2 to a subsurface position adjacent perforations P and below the sucker rod pump P.

A conventional sucker rod pump seat S is provided at the lower end of the tubing string 2 and is mounted in sealing relationship to a conventional sucker rod pump P. The seat S, as customary, is positioned adjacent the casing perforations P.

The sucker rod pump P is carried into the well in a conventional fashion by a sucker rod string R shown extending through the production tubing T to the surface of the well. Vertical manipulation of the sucker rod string R will cause axial reciprocation of pump P to transport fluids from the formation through the production tubing T to the surface of the well. It will appreciated by those skilled in the art that vertical manipulation of the sucker rod string R can be transmitted to the production tubing T, especially in those instances in which the well bore deviates from the vertical and the sucker rod string R engages the interior of the tubing T.

Figure 1:
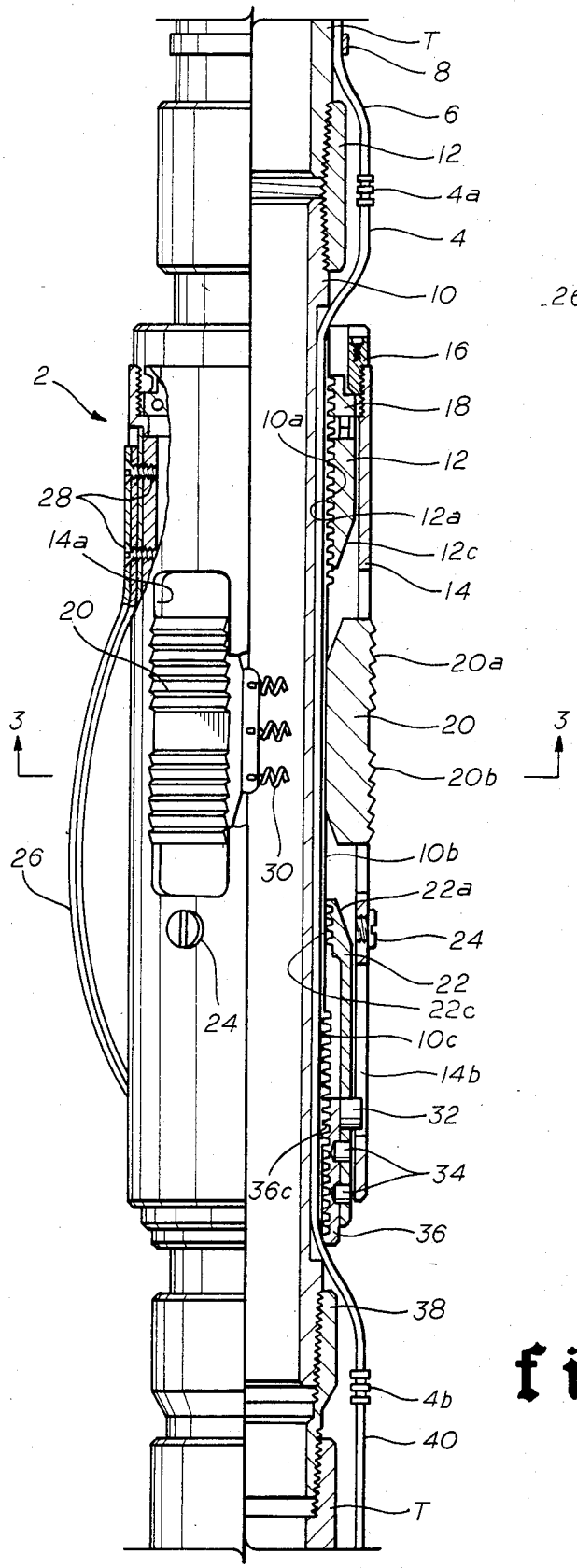
FIG. 1 is a view of the tubing anchor attached in the tubing string with the radially expandable anchoring slips in the retracted position.
Figure 3:
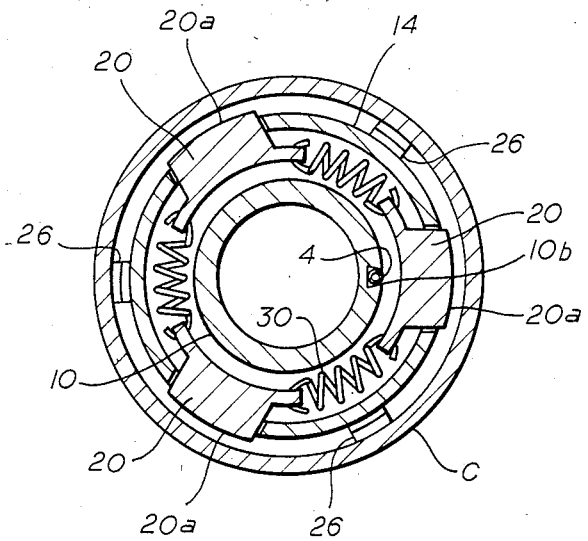
FIG. 3 is a cross-sectional view through the anchoring slips along section line 3—3.

Tubing anchor 2 is incorporated into the production tubing string to prevent vertical movement of the tubing string. The tubing anchor 2 comprises an axially extending tubular body 10 conventionally attached to the tubing T by an upper threaded coupling 12 and a lower threaded coupling 38 (FIG. 1). The tubular body 10 has a plurality of threads 10*a* adjacent its upper end and a second plurality of threads 10*c* adjacent its lower end. In the preferred embodiment of this invention, threads 10*a* are of an opposite hand from threads 10*c*. In other words, one series of threads comprises right hand threads while the other series of threads comprise left hand threads. At least one axially extending groove 10*b* is located along the exterior surface of tubular body 10 and extends through both upper and lower threads 10*a* and 10*c*. As shown in FIG. 3, the groove 10*b* has a dovetail cross-sectional configuration in the preferred embodiment of this invention.

An upper conical expander 12 having inner threads 12*a* engagable with tubular body threads 10*a* is positioned concentrically around tubular body 10 adjacent threads 10*a*. Expander 12 has a downwardly facing conical surface 12*c*. A similar lower expander 22 having internal threads 22*c* is located adjacent the lower end of the tubular body 10. Threads 22*c* are nonfunctional after assembly. In the retracted position of FIG. 1, threads 22*c* are not in engagement with threads 10*c*. Expander 22 has an upwardly facing conical surface 22*a*.

A plurality of radially expandable anchoring slips 20 are positioned concentrically encircling tubular body 10 between upper expander 12 and lower expander 22. Anchoring slips 20 have outwardly facing gripping teeth 20*a* and 20*b* for engaging the casing C upon radial expansion. In the preferred embodiment of this invention, gripping teeth 20*a* are downwardly facing and gripping teeth 20*b* are upwardly facing so that the anchoring slips can securely engage the coupling to prevent vertical movement in either direction. Anchoring slips 20 are received within openings or windows 14*a* defined within an exterior tubular housing 14 encircling the expanders 12 and 22 and the tubular body 10. A plurality of coil springs 30 extend circumferentially between adjacent anchoring slips and inwardly bias the anchoring slips to the retracted positions shown in FIG. 1. A torque pin 32 attached to lower expander 22 extends through an axially extending slot 14*b* located in the outer housing. Torque pin 32 thus rotationally secures outer housing 14 to lower expander 22 and the windows 14*a* rotationally secure each radially expandable anchoring slip 20 to the outer housing 14. Expander 22 is attached to expander sleeve 36 by means of one or more shear pins 34. Sleeve 36 has threaded connections 36*c* on its interior engagable with threads 10*c* located on the tubular body 10. Rotation of tubular body 10 will therefore cause movement of the expander sleeve 36 and the expander 22 relative thereto.

A nut assembly 16 and 18 secures the outer housing 14 to the tubular body 10. A flexible drag spring 26 is secured to tubular housing 14 by means of conventional screws 28. Drag spring 26 is outwardly biased and will engage the casing C to prevent rotation of the outer housing 14 relative to the casing. Thus rotation of the upper and lower expanders 12 and 22 and the anchoring slips 20 relative to the casing is resisted by drag spring 26. To secure the tubing anchor 2 and the tubing T with respect to casing C, the tubing T can be rotated thus imparting rotation to the tubular body 10. Rotation of tubular body 10 occurs while upper expander 12 is rotationally restrained by outer housing 14 and by drag springs 26. Therefore, the threads 10*a* and 12*a* impart axial movement of upper expander 12 relative to anchoring slips 20. The slips 20 and the tubular housing are initially moved downwardly relative to tubular body 10. Expander 22 moves downwardly into engagement with threads 10*c* whereupon continued rotation of tubular body 10 will cause expander 22 to move in the opposite direction toward slip 20 and upper expander 12. Continued rotation will shift the upper and lower expanders toward each other and will ultimately expand anchoring slips 20 outwardly into engagement with the casing C as the conical surfaces 12*c* and 22*a* engage the anchoring slip 20. Eventually sufficient rotation will be imparted to tubular body 10 to fully expand the anchoring slips and to prevent further axial movement of the tubing string T in either direction. In the preferred embodiment of this invention, the tubing anchor can be released by sufficient upward tension on the tubing string to shear the shear pins 34 holding the lower expander fixed relative to the tubular body. Shear pins 34 are, however, chosen with a sufficient strength to prevent release under normal anticipated tensile loads.

Figure 2:
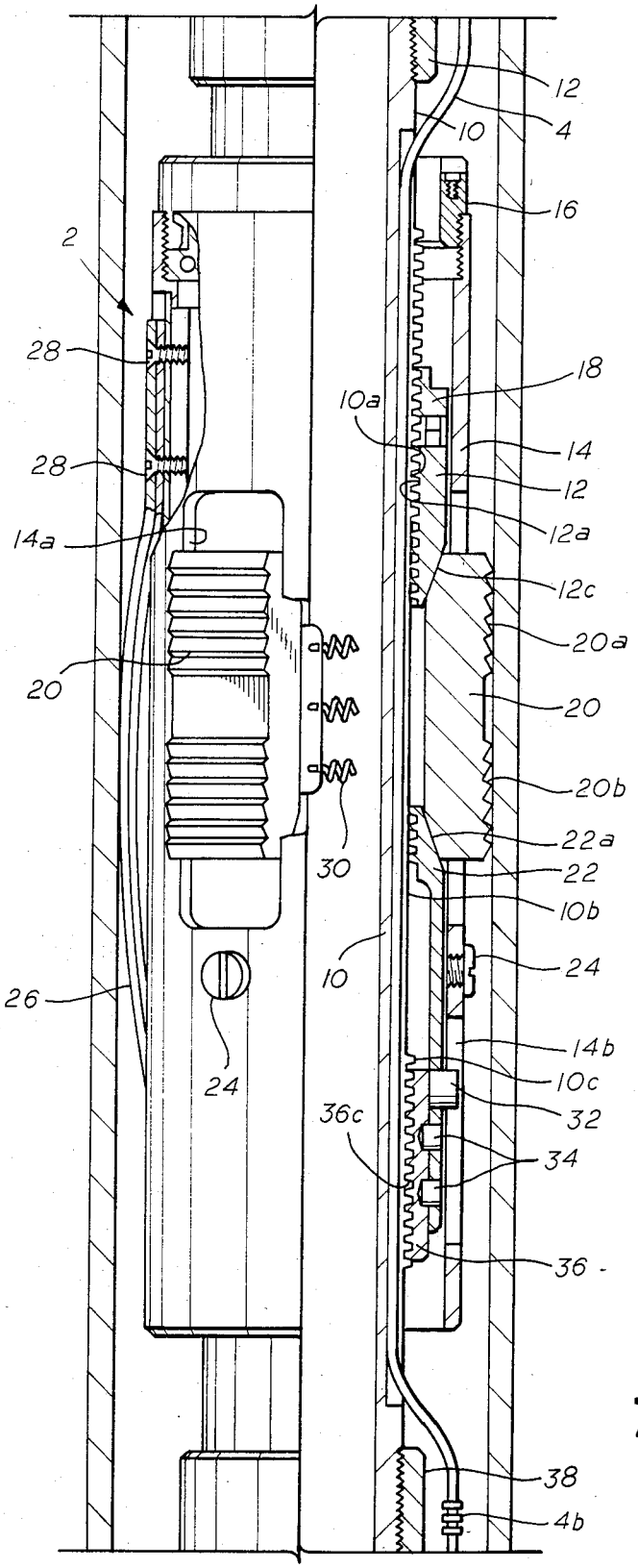
FIG. 2 is a view similar to FIG. 1 showing the anchoring slips in their radially expanded configuration.

Since the expandable anchoring slips are actuated by rotational movement of the tubular body 10 and the tubing string T, it will be apparent that tubing 6 attached to the tubing T would interfere with normal expansion of slips 20 since the tubing 6 must move rotationally with the tubing. As shown in detail in FIGS. 1–3, a separate conduit 4 is provided with upper and lower conventional attachments 4*a* and 4*b* for attachment to upper injection line 6 and lower injection line 40. In the preferred embodiment of this invention, conduit 4 comprises a separate section of flow line of the same type and diameter as that comprising injection line 6 and injection line 40. As shown in FIG. 3, conduit 4 is received within dovetail groove 10*b* and extends along the exterior of tubular body 10 through upper and lower expanders 12 and 22 and through the encircling anchoring slips 20. Groove 10*b* is sufficiently deep to permit conduit 4 to be received therein without interference with the threaded connection 10*a*–12*a* at the upper expander or with the threaded connection 10*c*–22*c* of the lower expander. Thus a path is provided for injection of fluids through the tubing anchor to a subsurface location below the tubing anchor, such as location adjacent the perforation P.

It will be appreciated by those skilled in the art that the apparatus described herein is not limited to use in a tubing anchor. For example, an apparatus as described herein could also be employed with other well tools employing radially expandable anchoring slips. For example, the apparatus described herein could be employed with a packer employing a radially expandable annular packing element in addition to radially expandable slips. The apparatus described herein could also be employed in a tubing hanger apparatus.

Although the invention has been described in terms of the specified embodiment which is forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to secured by Letters Patent is:

1. Apparatus engagable with the wall of a well bore and attached to a tubing string in the well bore to anchor the tubing string against axial movement, in which at least one separate fluid pipe is attached to the exterior of the tubing string, the apparatus comprising: a tubular body connected to the tubing string and having an axial passage of area equal to the tubing string bore communicating with the bore of the tubular body; anchoring slip means concentrically encircling the tubular body; expander means concentrically encircling the tubular body and adjacent to the anchoring slip means and relatively axially shiftable for expanding the anchoring slip means; means responsive to rotation of the tubular body for shifting the expander means axially relative to the tubular body to expand the slip means; said tubular body having an axially extending groove in its exterior surface extending axially through the encircling expander means and slip means, a second pipe disposed in the full length of said groove; and means for attaching the second pipe to the separate fluid pipe to conduct fluids to a well bore location below said tubular body without reduction in fluid passage area of the tubing string.

2. Apparatus engagable with the wall of a well bore upon rotation of a tubing string in the well bore to anchor the tubing string against axial movement in which at least one separate injection pipe is attached to the exterior of the tubing string, the apparatus comprising: a tubular body connected to the tubing string and having an equal area axial passage communicating with the bore of the tubing string; anchoring slip means disposed on the exterior of the tubular body; upper and lower expanders on opposite sides of the slip means, the upper and lower expanders being mutually axially shiftable toward each other for expanding the anchoring slip means; engagable threads on the tubular body and on at least one of the upper and lower expanders, rotation of the tubular body moving the upper and lower expanders relatively toward each other; drag means engaging the wall of the well bore for preventing rotation of the expanders and the anchoring slip means during rotation of the tubing string and the tubular body; a second pipe extending axially along the tubular body; an axial groove in the tubular body receiving the conduit, the groove extending radially within the threads on the body so as to provide clearance for the threaded engagement between the tubular body and the threadably engagable expanders, and means for attaching the second pipe to the separate injection pipe whereby fluid can be injected from above the anchoring apparatus through the injection pipe to a well bore location therebelow.

3. The apparatus of claim 2 further comprising a tubular housing surrounding the tubular body.

* * * * *